US011794086B2

(12) United States Patent
Hollomon et al.

(10) Patent No.: US 11,794,086 B2
(45) Date of Patent: Oct. 24, 2023

(54) GOLF PUTTING TRAINING SYSTEM AND METHOD

(71) Applicants: Ron Hollomon, McKinney, TX (US); Jake Jones, McKinney, TX (US)

(72) Inventors: Ron Hollomon, McKinney, TX (US); Jake Jones, McKinney, TX (US)

( * ) Notice: Subject to any disclaimer, the term of this patent is extended or adjusted under 35 U.S.C. 154(b) by 0 days.

(21) Appl. No.: 17/736,983

(22) Filed: May 4, 2022

(65) Prior Publication Data

US 2022/0355176 A1 Nov. 10, 2022

Related U.S. Application Data

(60) Provisional application No. 63/183,885, filed on May 4, 2021.

(51) Int. Cl.
*A63B 69/36* (2006.01)

(52) U.S. Cl.
CPC ..... *A63B 69/3676* (2013.01)

(58) Field of Classification Search
CPC ..... A63B 69/3676; A63B 71/0669; A63B 2071/0694; A63B 2220/56; A63B 2220/805; A63B 2220/833; A63B 2225/74; A63B 67/02
USPC ..... 473/19–225, 233, 257, 261, 265
See application file for complete search history.

(56) References Cited

U.S. PATENT DOCUMENTS

| | | | | | |
|---|---|---|---|---|---|
| 4,542,906 | A * | 9/1985 | Takase | A63B 69/3658 | 434/252 |
| 4,872,687 | A * | 10/1989 | Dooley | A63B 24/0021 | 473/184 |
| 5,860,648 | A * | 1/1999 | Petermeier | G07F 17/3297 | 273/371 |
| 6,540,620 | B1 * | 4/2003 | Consiglio | A63B 69/3676 | 473/150 |
| 6,702,690 | B1 * | 3/2004 | Albright | A63B 69/3676 | 473/219 |
| 2002/0022530 | A1 * | 2/2002 | Yoon | A63B 69/36211 | 473/150 |
| 2004/0137996 | A1 * | 7/2004 | Chou | A63B 69/3658 | 473/198 |
| 2006/0014589 | A1 * | 1/2006 | Kim | A63B 69/3614 | 473/233 |
| 2008/0009359 | A1 * | 1/2008 | Yun | A63B 69/3676 | 473/152 |
| 2016/0375338 | A1 * | 12/2016 | Pelz | A63B 69/3661 | 473/171 |
| 2021/0031083 | A1 * | 2/2021 | Stone | A63B 71/0619 | |

* cited by examiner

*Primary Examiner* — Nini F Legesse
(74) *Attorney, Agent, or Firm* — Bell Nunnally & Martin LLP

(57) ABSTRACT

A putting training device and method for monitoring and tracking a golfer's putting activities.

2 Claims, 5 Drawing Sheets

GOLF PUTTING TRAINING SYSTEM AND METHOD

CROSS-REFERENCE TO RELATED APPLICATIONS

The present application claims the benefit under 35 U.S.C. § 119(e) of U.S. Provisional Patent Application No. 63/183,885 filed May 4, 2021, which is incorporated herein by reference in its entirety as if fully set forth herein.

BACKGROUND

Technical Field

This invention relates generally to training devices, and more particularly, to systems and methods for golf putting training.

Background

Golf is a recreational sport that is very popular throughout the world. The game of golf challenges a golfer with their skills in controlling the direction and distance the ball is hit. Golfers spend large amounts of money on new clubs, balls, and training aids in an attempt to improve their games. There are dozens of nuances in a golfers swing that control the golfer's success. It has, therefore, been the case that there are dozens of devices which have been developed to aid the golfer in perfecting the swing of the golf club.

Many available training aids are very complicated and require golfers to change or manipulate their natural swings. Some training aids are impractical because they are too large and cumbersome to be taken to golf courses and practice facilities. Some devices have been used to help predict trajectory or detect a two-dimensional element of the swing. Many of these training aids are expensive and do not work. Some devices attach to the golfer or the club. While they may be of some value, the golfer becomes accustomed to the device's presence and weight and frequently cannot perform without the presence of the device.

Putting and short game comprises the majority of the shots taken during an average round of golf. Putting requires an unobstructed, smooth path for a golf ball to roll towards a target. Many training devices fail to consider this and, therefore, do not permit a practicing golfer to obtain a true representation of a putting stroke. One of the most important concepts in putting is maintaining consistency throughout the entire putting stroke in order to move the putter and hands down the target line. Many golfers have a tendency to pick their heads up too soon or immediately after a putting stroke. They are anxious to see if the ball is on the correct path towards the hole immediately after the ball leaves the putter face. Inconsistency may be the largest problem among golfers' putting games and can result in drastically higher scores. If the golfer is distracted, for example, by thoughts of where the ball is going, focus is taken off the task of keeping the putter and hands moving directly down the target line.

An inexpensive and effective putting training aid would be invaluable to improving a golfer's score. However, there are no such devices available which can be used both at home and on the golf course. Accordingly, there is a need of developing products that aid golfers in practicing putting.

SUMMARY OF THE INVENTION

The present invention comprises systems and methods for golf putting training. In various embodiments, the system and method may assist a golfer in practicing putting strokes by providing a new golf putting trainer mobile application in communication with one or more sensors. In some embodiments, the sensors may be coupled to a mat assembly including an elongate mat having a top surface. One or more of the sensors may be disposed, for example, in the bottom of a hole to provide an indication when a putt goes in the hole and/or under a surface of the mat to provide an indication when a ball rolls over the sensor. In some embodiments, the system may also include other sensors, for example, a light beam emitter and receiver disposed along the top surface of the putting mat to provide an indication when a ball rolls between the emitter and receiver. In some embodiments, the assembly may include a display and/or speaker to provide visible and/or audible indications of makes, misses, overall score and/or other information. In some embodiments, the assembly may be connectible via wired and/or wireless connections to other devices, such as a computer, cellphone, or other device. In some embodiments, a mobile app is provided that can receive signals from the assembly to track a user's training activities. In some embodiments, the assembly may be coupled to a power cord or may be battery powered and capable of being used with a plurality of training mats and/or on a putting green. In some embodiments, one or more of the sensors may be wireless sensors and housed in protective housings capable of being oriented to track a golfer's made and missed putts, such as, for example, being placed in a hole, placed on the ground near a hole, and/or stuck into the ground of a putting green.

The above summary of the invention is not intended to represent each embodiment or every aspect of the present invention. Particular embodiments may include one, some, or none of the listed advantages.

BRIEF DESCRIPTION OF THE DRAWINGS

A more complete understanding of the method and apparatus of the present invention may be obtained by reference to the following Detailed Description when taken in conjunction with the accompanying Drawings wherein.

DETAILED DESCRIPTION

The present invention is directed towards systems and methods for golf putting trainers for practicing one's putting stroke. In various embodiments, a new golf putting trainer device is provided that provides the user a way to monitor and track putting practice strokes resulting in muscle memorization and putting the golf ball straight and true. Even still another object of the present invention is to provide a new golf putting trainer device that is easy and convenient to set up and use.

Figure 1:
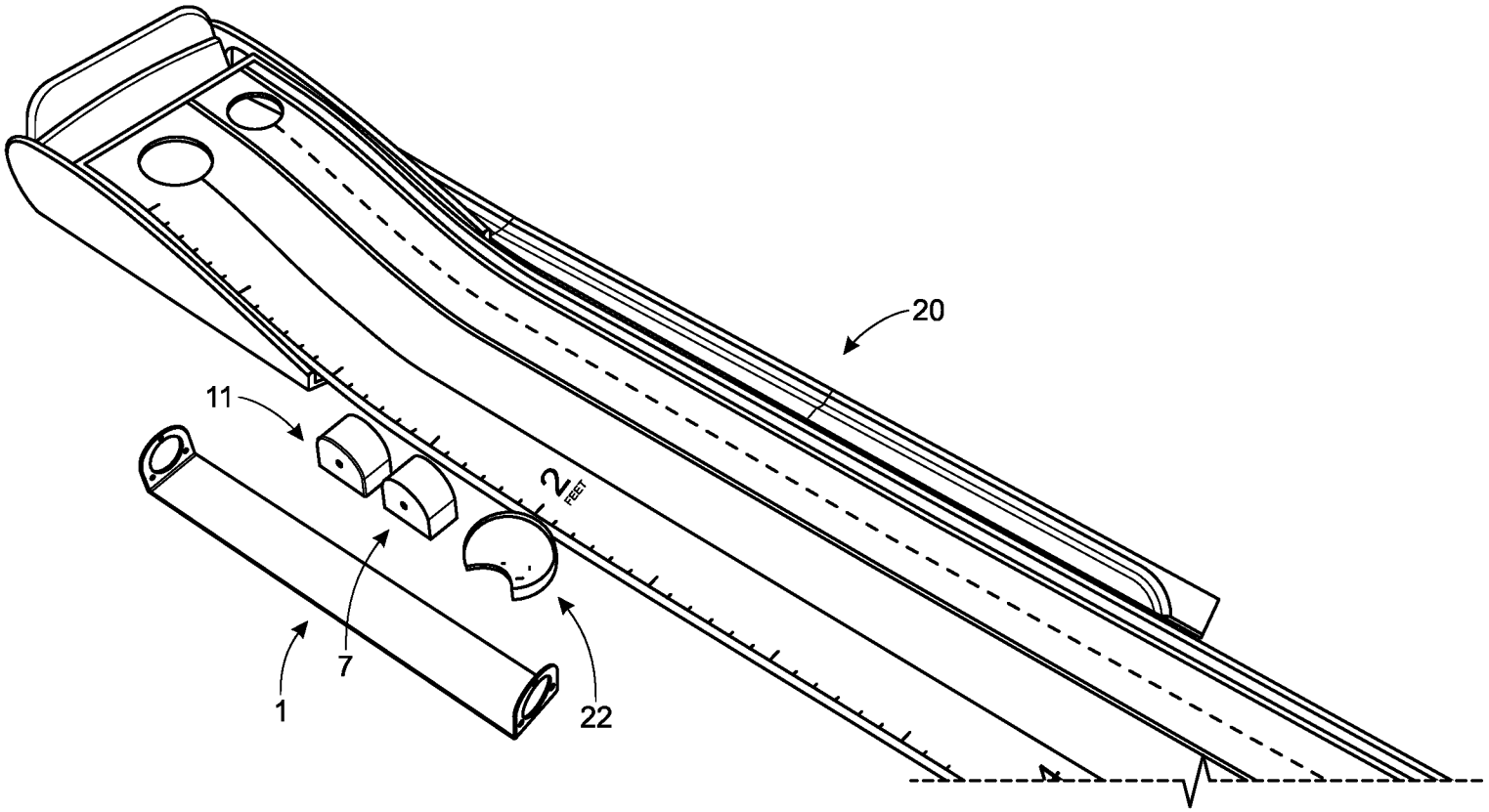
FIG. 1 illustrates various components of an embodiment of a putting training aid.

Referring now to FIG. 1, an exemplary putting mat 20 is shown along with a base 1, a sensor mount 7, a laser mount 11, and a hole sensor 22. FIG. 1 is a perspective view of a game apparatus in accordance with the present invention. In a described golfing embodiment, a golf ball or similar playing piece is struck by a player using a golf club or other article and the ball moves down the putting mat 20. This embodiment is most appropriate for golf putting practice where players try to putt golf balls into target holes having a hole sensor disposed therein. The putting mat is provided in front of the hole to provide a simulated putting green surface on which players may putt golf balls or otherwise direct playing pieces. The putting mat 20 includes a target end and a player end. The putting mat 20 can be an artificial grass carpet or similar surface. Preferably, the putting mat 20 can be folded or rolled and thus conveniently stored when not in use, thus allowing the game apparatus to occupy less space when the apparatus is not in use. In the described embodiment, the playing pieces and any other necessary equipment to direct the ball (such as a golf club, putter, croquet mallet, etc.) can be manually used by the player to hit the ball down the putting lane. A ball return mechanism can return the balls to the player after the player has hit the balls down the putting lane.

Figure 2A:
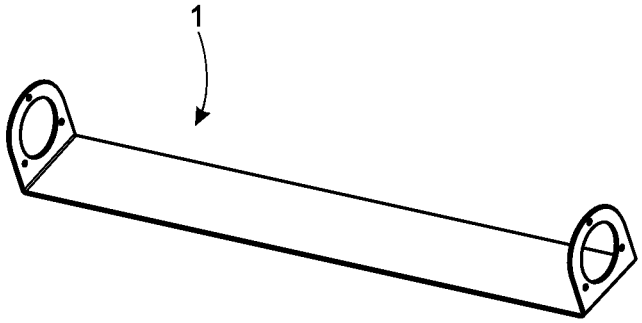
FIGS. 2A-2C illustrate various components of the putting training aid of FIG. 1.
Figure 2B:
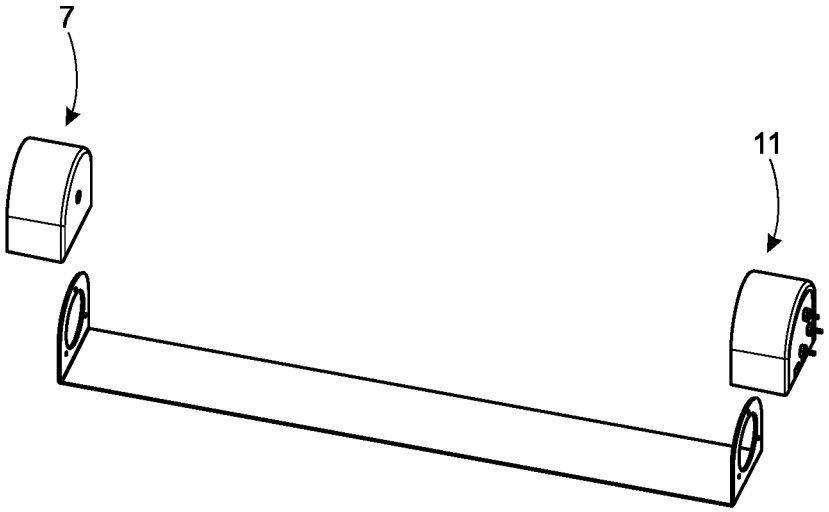
Figure 2C:
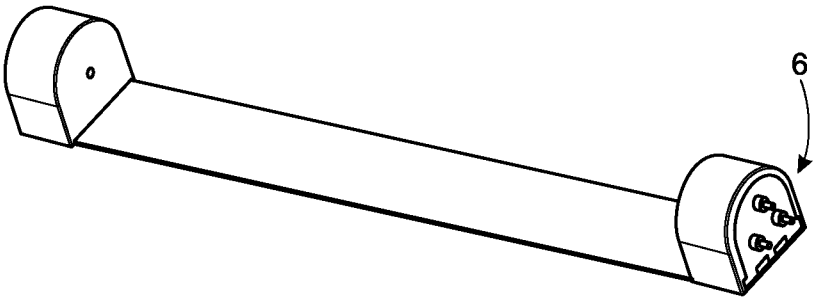

FIGS. 2A-2C illustrates a method of using the base 1 to properly position the sensor mount 7 and the laser mount 11. As shown in FIG. 2A, at a first step, the base 1 may be positioned in a putting lane. In some embodiments, the base 1 may be placed under the putting mat 20 or may be placed on a putting green between a putter and a hole. As shown in FIG. 2B, sensor mount 7 and laser mount 11 are slid over flanges on opposite ends of the base 1. As shown in FIG. 2C, the direction of the laser within laser mount 11 can be adjusted using thumb screws 6 to align the laser with the sensor within the sensor mount 7. While the base 1 facilitates alignment of the sensor and laser, in some embodiments, the laser mount 11 and sensor mount 7 may be placed directly on a playing surface without use of the base 1 or slots may be located on the putting mat 20 to receive the sensor and laser mounts therein.

Figure 3:
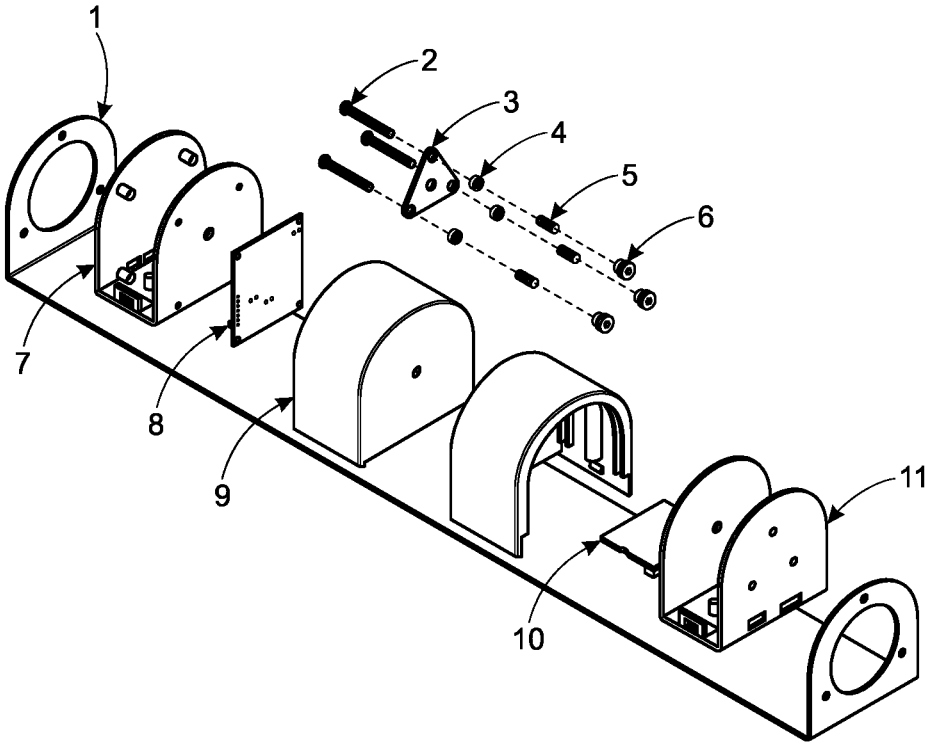
FIG. 3 is an exploded view of the components of FIGS. 2-2C.
Figure 4:
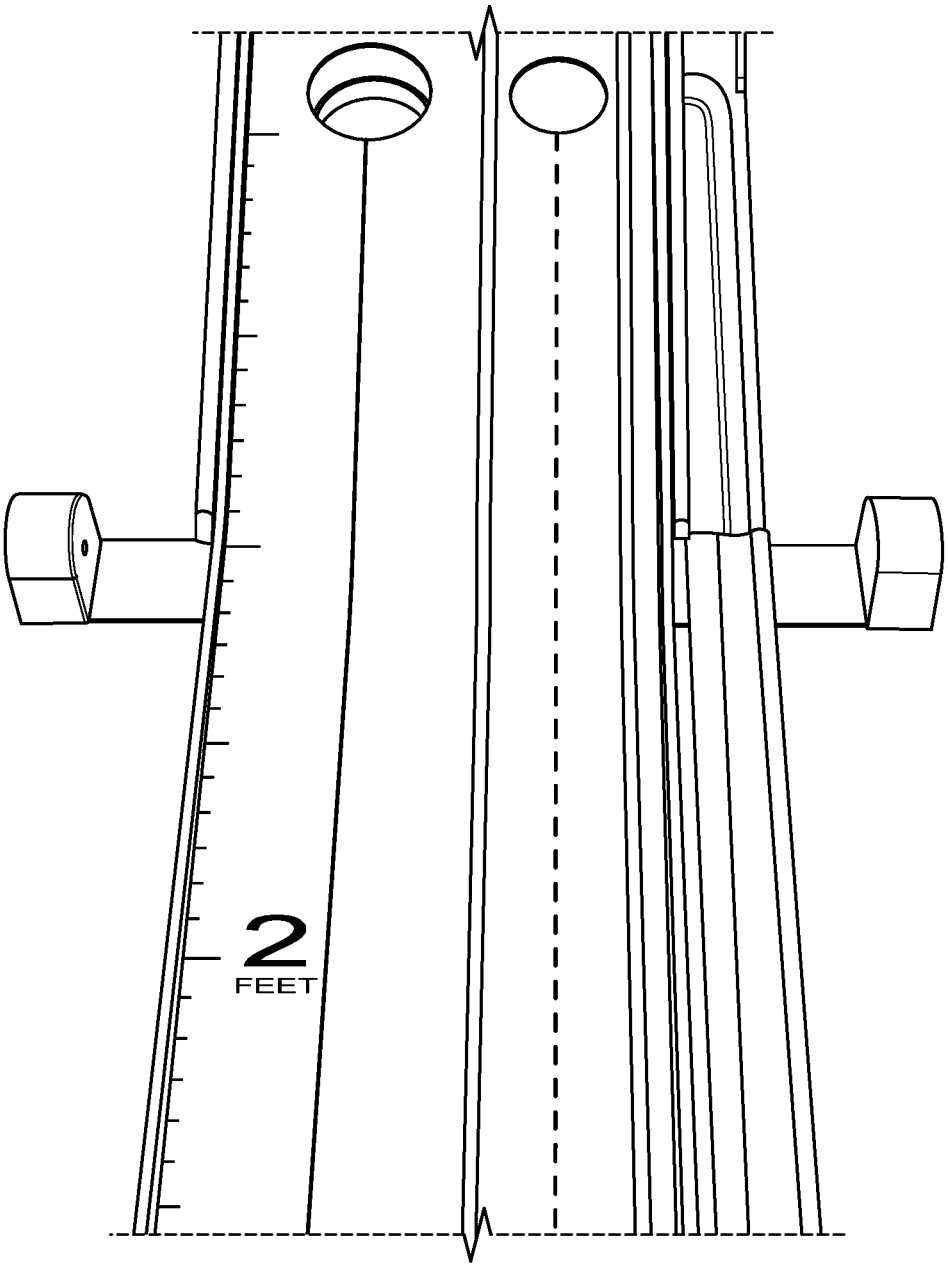
FIG. 4 is a perspective view of various components of the putting training aid of FIG. 1.

FIG. 3 shows an exploded view of an embodiment of a putting training aid assembly comprising a base 1, screws 2, aimer 3, hex nut 4, spring 5, thumb screw 6, sensor mount 7, sensor PCB 8, cover 9, laser PCB 10, and laser mount 11. FIG. 4 shows the laser and sensor mounts disposed on the base 1 on opposite sides of the putting mat 20. As can be seen, the laser beam crosses from one side of the putting mat to the other. In a preferred embodiment, two sensors are utilized, which desirably may be utilized to detect the number of putts attempted and the number of putts made. A first sensor may be attached to or placed in a target hole in order to detect the number of putts made. A second sensor or set of sensors may be disposed between the player and the target hole in order to detect the number of putts attempted. The second sensor may be a light source/sensor combination, which provides a light beam from a source to a sensor that is interrupted by a ball traveling towards target hole. In such embodiments, a ball traveling toward target hole interrupts the light beam between the source and sensor, thereby providing an indication of total putts, which would include made puts and putts that are hit but do not enter the target hole. Sensors may be powered by a suitable electrical power source (such as via electricity from an electric cord or powered with a battery or solar power or other source). The light sensors may be configured to count a ball passing therebetween as an attempt and then wait a predetermined time before counting another ball passing therebetween as a second attempt so that balls missing the hole and rolling back down the slope of the matt are not counted as two attempts. Each sensor is coupled to a mobile device and/or one or more of the other sensors. As will be appreciated, the sensors may be conventionally wired, coupled together and configured, such as under common microprocessor control, to provide counts of total putts, made putts, and/or missed putts, which may be accompanied by a display of elapsed time, real time, or the like. In yet other alternative embodiments, counters for two players may be included, such that total putts made in a predetermined elapsed time may be counted, etc.

In various embodiments, the putting mat may include a base station disposed under a raised portion of the mat with sensors placed in the hole of the putting mat and at a front edge of the raised portion. In some embodiments, the base station may include a power cord capable of being plugged in to a power source or may be battery powered. In some embodiments, one or more of the sensors may be wired or wirelessly coupled to the base station. In operation, a first pressure sensor may be configured to register when a golf ball passes over as an indication that a putt has been attempted and a second pressure sensor may be configured to register when a golf ball enters the hole as an indication that a putt was made. In some embodiments, a light emitter is disposed on one side of the mat and a light detector is disposed on the other side of the mat to register when a golf ball passes by. In various embodiments, additional and/or alternative sensors may be incorporated. In some embodiments, the sensors may be built into the mat or may be independent from the mat. For example, the light sensors may be placed on the floor next to the mat or on the surface of the mat or mounted to opposite sides of the mat. In some embodiments, the hole sensor may be a disc or similarly shaped device capable of being placed in a hole at, for example, a golf course and the laser emitter/receiver may be placed on a green proximate to the hole. In some embodiments, the emitter/receiver may include a stake or other protrusion to facilitate being inserted into the grass on the green. In some embodiments, the circuitry and other components of the base station may be included in a standalone unit, may be incorporated into the hole sensor and/or may be incorporated into one or more of the laser emitter and/or receiver.

Figure 5A:
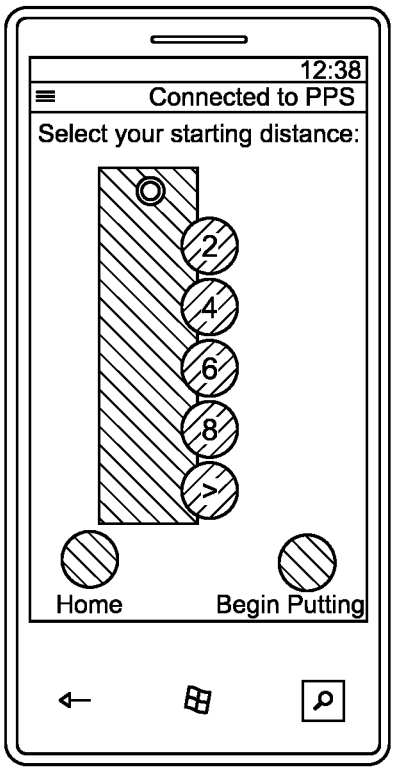
FIGS. 5A-5B illustrate screenshots of a mobile app for an embodiment of a putting training aid.
Figure 5B:
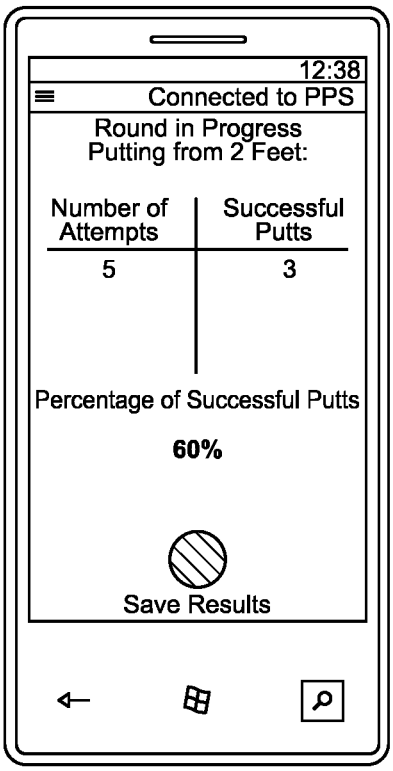

Referring now to FIGS. 5A and 5B, a mobile device wirelessly connected to the putting training device is shown. In this embodiment, the training device is disposed in or next to a putting mat and is connected to a wireless device via, for example, Bluetooth. The wireless device is connected to a central server and/or database via a wireless connection, such as, wifi and/or cellular. In the embodiments shown, the app may be configured to connect to one or more of the training devices, such as a base station, hole sensor, and/or attempt sensors. Once connected, the user may commence a training round. In one configuration, the App recommends attempting a plurality of putts at a plurality of distances. In some embodiments, the number and distances may be manually changed by the user. As the golfer attempts putts, the App records the attempts and the makes based on information received from the sensors. In some embodiments, the App may utilize a camera and/or microphone of the mobile device to, for example, determine distance, register attempts, and/or other monitor other information. In various embodiments, the App may record the attempts, makes, misses, distances, and/or other information. In various embodiments, the App may record and/or display historical information and/or information of other users of the device and/or other devices.

The system may further include optical sensors including an emitter spaced in an opposed relationship to a receiver along a putting lane. The emitter is adapted to direct a beam of light across the passageway of the putting lane to its associated receiver. Consequently, when an object (a golf ball) passes between the sensors, the light beams are interrupted, generating a signal indicating the object has passed by. The type of emitter and receiver is not limited. By way of example, the emitter may comprise a red light emitting diode (LED) and the receiver may comprise photoconductive cells. The system may further include one or more sensor elements operable to detect the presence of a golf ball in proximity to the hole. By way of example, a sensor may be positioned within the hole to detect the presence of a golf ball within the cup. The type of sensor is not limited, and includes optical, magnetic, electric, and mechanical sensors. By way of example, one or more pressure sensors may be positioned in a bottom of the cup. For cups having a flagpole, the one or more pressure sensors may be configured to be placed around the flagpole. Both the emitter-receiver pair and the pressure sensor may be operably connected to a control unit and configured to send a signal to the control unit when the light beam produced by the emitter is interrupted and when the pressure sensor is activated. The control unit, in turn, may generate appropriate output (e.g., increase of attempt count or increase of made putt count).

Although various embodiments of the method and apparatus of the present invention have been illustrated in the accompanying Drawings and described in the foregoing Detailed Description, it will be understood that the invention is not limited to the embodiments disclosed, but is capable of numerous rearrangements, modifications, and substitutions without departing from the spirit and scope of the invention.

What is claimed is:

1. A system for tracking putting training, the system comprising:

a substantially flat base having protrusions at opposite ends thereof, wherein the substantially flat base is configured to be removably placed under a putting mat such that the protrusions extend upwardly on opposite sides of the putting mat;

a photoemitter housed in a laser mount configured to be removably mounted to a first protrusion of the base in a first mode of operation and configured to be placed directly on a playing surface in a second mode of operation;

a photodetector housed in a sensor mount configured to be removably mounted to a second protrusion of the base in the first mode of operation and configured to be placed directly on the playing surface in the second mode of operation such that the photodetector faces the photoemitter;

whereby a detection beam is emitted from the photoemitter towards the photodetector and configured to send a putt attempt signal when the detection beam from the photoemitter is broken as a golf ball passes between the photoemitter and the photodetector;

a hole sensor removably placed in a ball-receiving cup and configured to send a putt made signal when a presence of the golf ball in the ball-receiving cup is detected; and a mobile device wirelessly coupled to one or more of the hole sensor, the photoemitter, and the photodetector, wherein the mobile device is configured to receive the putt attempt signal and the putt made signal and operative to track a number of attempts and a number of successful putts.

2. The system of claim 1, wherein the laser mount is configured to slide over the first protrusion of the base when removably mounted thereto and the sensor mount is configured to slide over the second protrusion of the base when removably mounted thereto.

* * * * *